US007744412B2

(12) United States Patent
Melzner

(10) Patent No.: US 7,744,412 B2
(45) Date of Patent: Jun. 29, 2010

(54) APPARATUS FOR MAKING ELECTRICAL CONTACT WITH LUMINOUS MEANS IN SPOTLIGHTS

(75) Inventor: Erwin Melzner, Frasdorf (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 163 days.

(21) Appl. No.: 11/988,691

(22) PCT Filed: Jul. 5, 2006

(86) PCT No.: PCT/EP2006/006755

§ 371 (c)(1),
(2), (4) Date: Mar. 4, 2008

(87) PCT Pub. No.: WO2007/006540

PCT Pub. Date: Jan. 18, 2007

(65) Prior Publication Data

US 2009/0068877 A1 Mar. 12, 2009

(30) Foreign Application Priority Data

Jul. 13, 2005 (DE) ..... 20 2005 011 415 U

(51) Int. Cl.
*H01R 13/40* (2006.01)

(52) U.S. Cl. ..... 439/602; 439/263; 439/617; 439/268; 439/682; 439/683; 439/236; 439/168; 439/220

(58) Field of Classification Search ..... 439/602, 439/263, 617, 268, 682, 683, 236, 168, 220
See application file for complete search history.

(56) References Cited

U.S. PATENT DOCUMENTS

| | | | | |
|---|---|---|---|---|
| 1,738,028 | A | 12/1929 | Alden | |
| 4,540,227 | A | 9/1985 | Faraci | |
| 5,073,124 | A * | 12/1991 | Powell | 439/197 |
| 5,108,301 | A | 4/1992 | Torok | |
| 5,254,012 | A * | 10/1993 | Wang | 439/263 |

(Continued)

FOREIGN PATENT DOCUMENTS

DE G 82 11 251.7 8/1982

(Continued)

OTHER PUBLICATIONS

International Search Report, dated Oct. 27, 2006, corresponding PCT/EP2006/006755.

(Continued)

*Primary Examiner*—Tho D Ta
(74) *Attorney, Agent, or Firm*—Christie, Parker & Hale, LLP

(57) ABSTRACT

An apparatus for making electrical contact with luminous means in spotlights, which contain a glass vessel, a luminous means base and contact pins for the power supply is provided. The apparatus comprising a luminous means holder with at least two socket pairs for accommodating the contact pins of different luminous means. The socket pairs are arranged in clamping pieces, whose mutually opposite connecting faces can be removed from one another in order to accommodate the contact pins of the luminous means and can be guided towards one another in order to make electrical contact with the contact pins of the luminous means.

38 Claims, 8 Drawing Sheets

U.S. PATENT DOCUMENTS 5,508,628 A * 4/1996 Pfaff ..... 324/755
6,960,092 B1 * 11/2005 Hussain et al. ..... 439/263

FOREIGN PATENT DOCUMENTS

DE 198 16 364 A1 10/1999
DE 198 16 364 C2 10/1999
WO WO 98/12777 A2 3/1998
WO WO 98/48490 A1 10/1998
WO WO 99/08346 A1 2/1999

OTHER PUBLICATIONS

Translation of the relevant parts of DE G 82 11 251.7, previously filed Jan. 11, 2008.
English translation of International Preliminary Examination Report for corresponding PCT application No. PCT/EP2006/006755, dated Jan. 29, 2008.

* cited by examiner 50
51
34
44
4
1
3
9
2
9'
91
93
94
92
35
52
45

APPARATUS FOR MAKING ELECTRICAL CONTACT WITH LUMINOUS MEANS IN SPOTLIGHTS

CROSS-REFERENCE TO A RELATED APPLICATION

This application is a National Phase Patent Application of International Patent Application Number PCT/EP2006/006755, filed on Jul. 5, 2006, which claims priority of German Utility Model Application, Number 20 2005 011 415.4, filed on Jul. 13, 2005.

BACKGROUND

The invention relates to an apparatus for making electrical contact with luminous means in spotlights.

DE 198 16 364 C2 has disclosed a lamp housing, which is used for accommodating a luminous body, a transparent cover plate in the form of a protective plate or a lens plate and a reflector. Burners or lamps, preferably diskharge lamps with a base at one end, with a vertical or horizontal installed position, i.e. in each case at right angles to the optical axis, or with an axial installed position, i.e. in the optical axis, are used as luminous means or luminous bodies.

The lamps have a gas-filled glass body with electrodes arranged therein, a lamp base, through which the feed lines to the electrodes are passed, and two or more contact pins, which are arranged on that end of the lamp base which is opposite the glass body. The contact pins are inserted into the sockets of a lampholder connected to the lamp housing in order to connect the lamp to a voltage source, a tight fit between the sockets and the contact pins being necessary for the high current levels of the lamp current to be transmitted.

At the same time, the contact pins, for example of diskharge lamps with a base at one end, are used as fastening means for the diskharge lamp. Since, as lamp powers increase, also the physical size of the diskharge lamps and in particular the physical, length of the glass body and of the lamp base increase, the lamps in the case of relatively high lamp powers have such a physical size that, in particular in the case of a horizontal installed position of the diskharge lamps, considerable forces are exerted on the contact pins which, in addition to the power supply, also act as fastening contacts.

These forces result in an impairment of the contact between the contact pins and the sockets of the lampholder, which is associated with increased transfer resistance when transmitting the lamp current, a displacement of the lamp from the focal point of the reflector and, as a result of this, a reduced luminous efficiency and with a transmission of the forces into the lamp interior, which may result in impermissible voltages and ultimately in failure of the lamp.

The disadvantages of mounting the lamp exclusively via the contact pins are not only noticeable in the steady-state range over the physical size of the lamp, however, but in particular also in the dynamic range during transport of a spotlight or its operation with jerky pivoting movements, impacts on the lamp housing and the like.

In order to be able to use a lamp housing for lamps with different lamp base diameters without replacing an accommodating device and to be able to use the contact pins of the lamps exclusively for transmitting the lamp current, in the case of the lamp housing known from DE 198 16 364 C2 the accommodating device comprises clamping jaws, which engage around the lamp base and can be adjusted by means of the adjusting device into an opening position, in which the lamp base is released, and into a locking position, in which the lamp base is fixed. The adjusting device comprises a latch with two sloping faces, which are designed to be identical geometrically and bear against the upper and lower clamping jaw in such a way that, when the latch is adjusted, the clamping jaws are spread apart radially.

When the adjusting device is actuated for the purpose of opening and closing the clamping jaws, at the same time an opening and closing of the sockets accommodating the contact pins of the luminous means takes place, so that, as a result of the contact pins being released at the same time, when the adjusting device is actuated for opening and closing the clamping jaws the luminous means can be removed easily as a result of the luminous means base being released or a luminous means can be inserted in the opening position of the lampbracket.

Generally, the lampholders or luminous means holders, depending on the power level of the spotlight, are designed for accommodating a luminous means corresponding to this power level, i.e. a lamp or a burner having a predetermined power consumption and/or power output. If a luminous means having a different power level is intended to be used in order to make use of the spotlight housing in a way which is largely independent of the power, this fails because of the different distances between and diameters of the contact pins of the luminous means, which generally increase as the power of the luminous means increases as a result of the different current consumption of luminous means having different power levels and for reasons of the mechanical construction of the luminous means. When using a spotlight housing, this makes it necessary to replace not only the luminous means holder but also the entire lamp mount, which accommodates and is connected to the luminous means holder, although the lamp mount is capable of accommodating lamps or burners with different dimensions, in particular the luminous means base.

SUMMARY

The object of the present invention is to specify an apparatus for making electrical contact with luminous means in spotlights which accommodates luminous means of different power levels without it being necessary to replace the lamp mount or the luminous means holder.

An exemplary solution according to an exemplary embodiment of the invention makes it possible to accommodate luminous means having different power levels in a spotlight without it being necessary to replace the lamp mount or the luminous means holder.

The exemplary solution according to the invention is based on the consideration of providing the precondition for using a spotlight housing for different power levels as a result of socket pairs for different luminous means in the luminous means holder, without it being necessary to replace individual elements of the spotlight, in particular the luminous means holder or the lamp mount.

Accordingly, in accordance with a further feature of the invention the sockets of the socket pairs can have different distances from one another and/or diameters.

In order to center the luminous means, the socket pairs or sockets are arranged in such a way that the central point of the luminous means is arranged over the mid-axis of the luminous means holder, so that, in accordance with a further feature of the invention, the socket pairs are arranged symmetrically with respect to the axes of symmetry of the luminous means holder.

If the light spot of the luminous means is not located in the center of the luminous means, in an alternative embodiment the socket pairs can be arranged in such a way that they are offset with respect to one another in relation to at least one axis of symmetry of the luminous means holder.

In order to accommodate luminous means bases of luminous means with different power levels, the contact pins of which are spaced apart in such a way and have such a diameter that the different socket pairs would overlap one another, in accordance with a further feature of the invention the socket pairs can be arranged in such a way that they are separated from one another or offset with respect to one another in relation to at least one axis of symmetry of the luminous means holder and, if necessary, merge at least partially with one another, so that, for luminous means with different power consumptions and/or power outputs, the distance between and/or the diameter of the sockets increase with the increasing power consumption and/or power output of the luminous means.

In order to allow for a more compact design, the sockets are not arranged in the transverse axis of the luminous means holder, but are arranged in such a way that they are rotated with respect to the transverse axis, so that the connecting lines of the socket pairs form different angles with respect to an axis of symmetry of the socket.

In an exemplary embodiment of the invention, the sockets are formed from socket parts, which are arranged in clamping pieces, whose mutually opposite connecting faces can be removed from one another in order to accommodate the contact pins of the luminous means and can be guided towards one another in order to make electrical contact with the contact pins of the luminous means.

This exemplary embodiment of the invention firstly makes simple coupling possible when making contact between the sockets and the contact pins of a luminous means with a mechanism for opening and closing the clamping jaws in order to accommodate a luminous means base for relieving the electrical contacts of load and secondly makes possible the formation and arrangement of a large number of socket pairs for luminous means having different power levels. In this case, the shape and cross sections or diameters of the sockets and the distances between the socket pairs can be varied as desired without design problems occurring in the arrangement of the socket pairs or luminous means needing to be arranged outside the axis of symmetry of the luminous means holder and therefore, for example, outside the axis of symmetry of a reflector. At the same time, optimum contact-making between the sockets and the contact pins of the luminous means is ensured which is largely independent of tolerances since the clamping pieces are joined together, for example, under spring prestress corresponding to the diameter or the cross-sectional shape of the contact pins of the luminous means and/or the required clamping force.

As a result of a symmetrical or asymmetrical formation of the socket parts on the mutually opposite connecting faces of the clamping pieces, the opening and closing of a lamp bracket can be combined with the opening and closing of the electrical connection between the sockets or socket pairs and the contact pins of the luminous means, so that when the lamp bracket is open the luminous means base is inserted into the lamp bracket and the contact pins into the luminous means holder and, by actuating the connecting apparatus, both the position is secured and electrical contact is made with the luminous means.

The socket parts can be designed to be both symmetrical and asymmetrical in relation to the connecting faces of the clamping pieces. In the same way, the socket parts can be designed to be semi-cylindrical or polygonal, in particular rectangular and hexagonal.

The various sockets can either merge with one another or be in the form of individual, separate sockets and socket pairs. In this case, the socket pairs can be arranged such that they are offset with respect to one another as a function of the distance between the contact pins and their diameter and therefore as a function of the distance between the socket pairs and their diameter.

In the case of socket pairs which are arranged more closely to one another in comparison with their diameter, the separating face between the clamping pieces can also be angled or bent so that sockets or socket pairs can be provided for different luminous means even in the case of a restricted physical size of the luminous means holder. In the case of sockets or socket pairs which are arranged at an angle or bent with respect to one another, the socket parts are shaped in such a way that they provide the desired cross section when joined together, i.e. the sections adjacent to the separating line are flattened in the case of, for example, semicircular socket parts, in order that the socket parts do not interlock when the clamping pieces are brought together.

In order to arrange sockets or socket pairs at an even smaller distance from one another given an enlarged diameter at the same time, i.e. for an even more compact design of the luminous means holder, the arrangement of one or more passive intermediate clamping pieces is provided in accordance with a further feature of the invention, so that the arrangement of a large number of sockets or socket pairs is possible even in the case of a small physical size of the luminous means holder.

Both in the case of an arrangement of two clamping pieces and in the case of an arrangement of two clamping pieces and one or more intermediate clamping pieces, sockets or socket pairs can be provided for more than two luminous means.

An exemplary configuration of the solution according to the invention is characterized by the fact that the clamping pieces or intermediate clamping pieces are in the form of metal jaws.

In order to electrically isolate the sockets, the clamping pieces and intermediate clamping pieces have insulation, which runs substantially at right angles to the separating line or to the connecting faces and is either arranged as distance or as an insulating layer between the clamping piece parts or intermediate clamping piece parts which contain the sockets of one pole and the clamping piece parts or intermediate clamping piece parts which contain the sockets of the other pole.

Exemplary, the clamping piece parts or intermediate clamping piece parts are connected to one another in articulated fashion at their ends which are opposite the sockets, so that they form a U-shaped holder, at whose ends the sockets are arranged.

In order to form a defined bracing force of the clamping piece parts or intermediate clamping piece parts, they are preferably prestressed in a sprung manner in the joining direction.

An exemplary configuration of the solution according to the invention is characterized by a modular design with a universal holder frame, which is provided for a specific luminous means holder and into which inserts for differently dimensioned luminous means holders can then be inserted, the inserts comprising a combination of preferably metallic clamping pieces and preferably ceramic supporting and filling materials.

The universal holder frame preferably comprises a fixed and a movable part, the movable part making the pressing or clamping of the clamping pieces possible. In this case, the force is either absorbed directly by specially designed clamping pieces or is transmitted by struts onto the clamping pieces. A significant advantage of this modular design is the possibility of being able to replace all of the parts lying within the insert.

Correspondingly, the luminous means holder has a holder frame, into which different, replaceable socket inserts can be inserted, which contain the clamping pieces and supporting elements, which are arranged at least partially between the clamping pieces and the holder frame.

In each case one clamping piece part is associated with the fixed and movable frame parts of the holder frame, the movable frame parts being operatively connected to the clamping piece parts.

In accordance with a further feature of the invention, the luminous means inserts can be designed in such a way that they can be rotated through 180° in order to be able to set, for example, a different distance between the sockets or different socket diameters.

This further-reaching solution can also be used to pivot corroded sockets, which are on the inside, for example, outward so that sockets with which electrical contact can always be made correctly are arranged on the inside, i.e. on the mutually adjacent faces of the first and second clamping piece parts.

BRIEF DESCRIPTION OF THE DRAWINGS

The basic concept of the invention and further advantages and features of the invention will be explained with reference to exemplary embodiments illustrated in the figures, in which.

DETAILED DESCRIPTION

Figure 1:
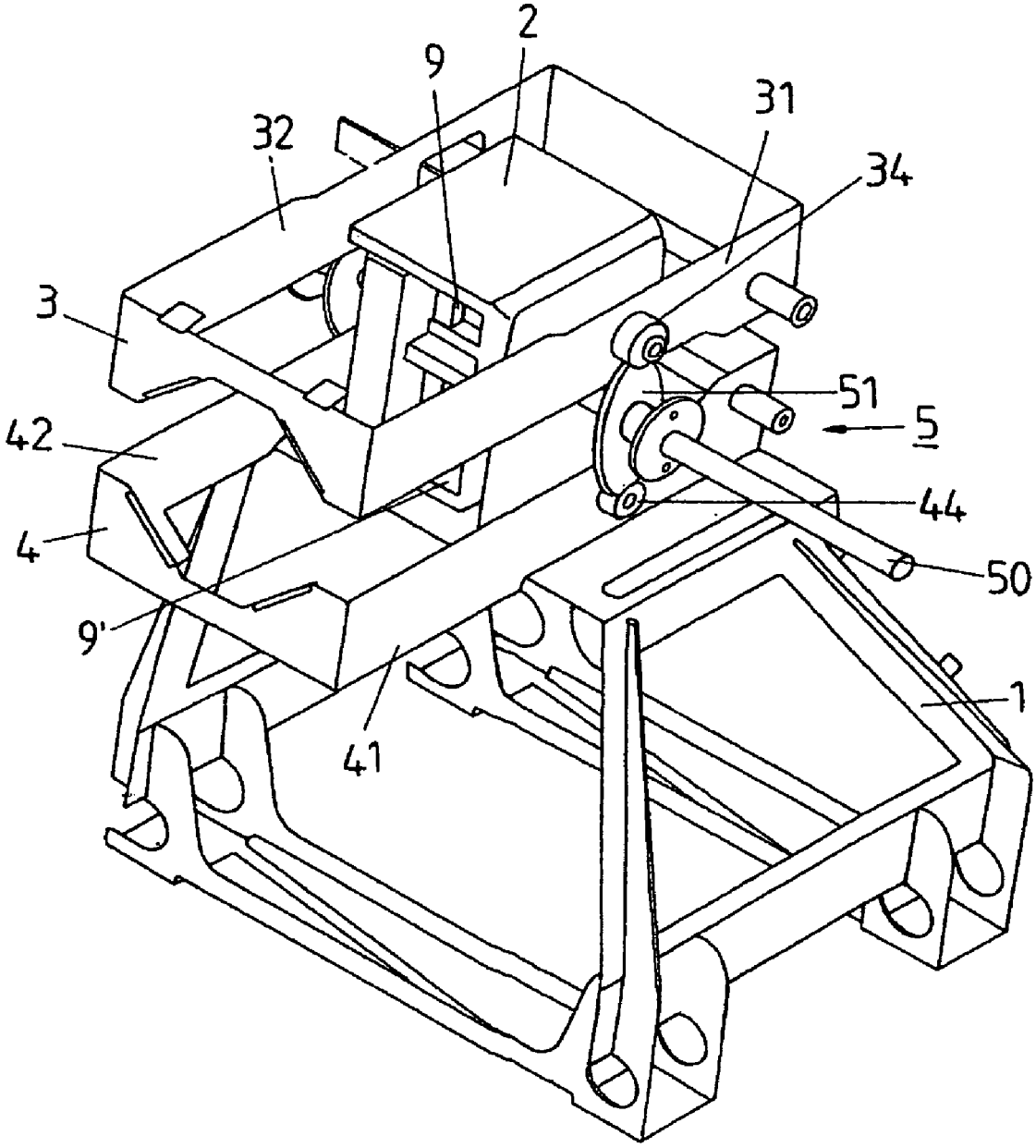
FIG. 1 shows a perspective illustration of an accommodating apparatus for a luminous means with clamping jaws supporting the luminous means base and a socket for accommodating the contact pins of the luminous means.

FIG. 1 shows, in a perspective view, a holder mount 1, which is connected to a luminous means housing (not illustrated in any more detail) for a spotlight via a spring-elastic bearing and accommodates a luminous means holder 2 with sockets 9, 9' for the power supply, into which sockets the contact pins of a luminous means, for example a lamp or a burner, in particular a diskharge lamp, are inserted.

The luminous means (not illustrated in any more detail) has an elongate, gas-filled glass body, a luminous means base and contact pins for connection to the sockets 9, 9' of the luminous means holder 2. As a result of the length of the glass body and its weight and the weight of the luminous means base of the luminous means, considerable forces, in particular dynamic forces in the case of a sudden change of direction of the luminous means housing or impacts acting on the luminous means housing or the spotlight and the like, act on the contact pins of the luminous means, via which the luminous means is connected to the luminous means holder 2 and therefore to the luminous means housing via the holder mount 1, when there is no additional accommodating apparatus. Since these forces are both transmitted into the luminous means interior and can result in impermissible voltages and failure of the luminous means there and also impair the electrical contact between the contact pins and the sockets 9, 9', the luminous means power is reduced and there is the risk of premature failure of the luminous means.

In order to reduce or eliminate the forces acting on the contact pins and in order to improve the retaining and clamping effect for the luminous means, an accommodating apparatus in the form of two clamping jaws 3, 4 is provided, which clamping jaws 3, 4 surround the luminous means base axially with respect to one another and at a distance and clamp it in a force-fitting and/or interlocking manner.

The upper clamping jaw 3 and the lower clamping jaw 4 are each connected to two lever arms 31, 32 and 41, 42, respectively, which are connected to one another at their ends opposite the clamping jaws 3, 4 via transverse webs and bear flat against the luminous means holder 2. Connecting rods are provided parallel to the transverse webs between the lever arms 31, 32 and 41, 42 of the upper and lower clamping jaw, 3, 4 and are connected to the holder mount 1 via spring-elastic supports.

As a result of the spring-mounting of the lever arms 31, 32 and 41, 42 and therefore the clamping jaws 3, 4, in the event of a movement of the luminous means brought about by impacts, for example, the accommodating apparatus is also moved in the same plane, so that the contact pins of the luminous means remain free from stresses. As a result of the likewise elastic support of the luminous means holder 2 via spring-mounting with respect to the holder mount 1, it is ensured that no forces are transmitted to the contact pins of the luminous means, so that the contact pins are used exclusively for transmitting the electrical power.

The upper and lower clamping jaws 3, 4 have a trapezoidal cutout, so that the individual sides of the trapezoidal cutouts bear with point-to-point contact against the conventionally cylindrical luminous means base in the clamped-in state of the luminous means.

In order to adjust the clamping jaws 3, 4 from an opening position, in which the luminous means base is released for removal of the luminous means, into a closing or locking position, in which the clamping jaws 3, 4 clamp in the luminous means base and fix the luminous means in its position, an adjusting device 5 with an adjusting element 51, 52, which acts on the lever arms 31, 32 or 41, 42, and an actuating element for manually actuating the adjusting device 5 is used.

Figure 2:
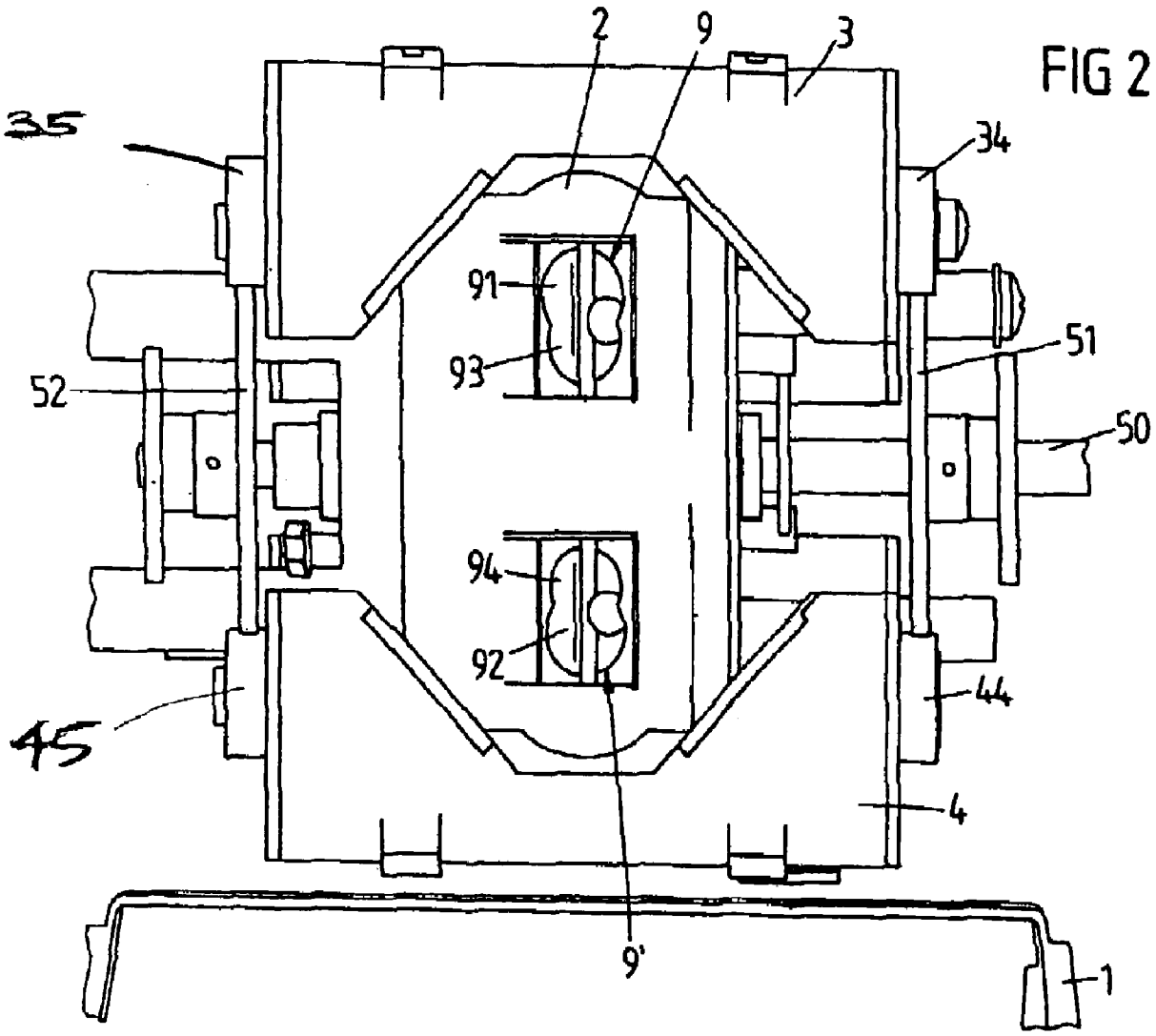
FIG. 2 shows a front view of the clamping jaws and the luminous means holder as shown in FIG. 1.

The adjusting element comprises, as can be seen in particular from the front view in FIG. 2, ellipsoidal disks 51, 52, which are arranged on both sides of the lever arms 31, 32 and 41, 42 and whose peripheral rim interacts with bronze bearings 34, 35 and 44, 45. If the large axis of the ellipsoidal disk 51, 52 is located between the two bronze bearings 34, 44 and 35, 45, the lever arms 31, 32 and 41, 42 and therefore the upper and lower clamping jaws 3, 4 are moved apart from one another so as to remove or replace the luminous means in the opening position. If, on the other hand, the small axis of the ellipsoidal disk 51, 52 is located between the two bronze bearings 34, 44 and 35, 45, the lever arms 31, 32 and 41, 42 and therefore the upper and lower clamping jaws 3, 4 are brought together so as to bear against the luminous means base in a force-fitting and interlocking manner in the closing or locking position.

The actuating element comprises an adjusting spindle 50, which is passed through the mid-point of the ellipsoidal disks 51, 52 and through the luminous means holder 2 and, in a manner which is not illustrated in any more detail, is connected to an adjusting lever or an adjusting knob for the manual actuation of the adjusting device outside of the spotlight housing.

The front view shown in FIG. 2 shows the twin sockets 9, 9' for accommodating the contact pins of a luminous means for the supply of current which are suitable for luminous means with contact pins of different dimensions and distances from one another and therefore in general different luminous means power. The contact pins of a 12 kW diskharge lamp can therefore be inserted into the sockets 93, 94, which have a relatively small distance from one another, of the twin sockets 9, 9', while the contact pins of an 18 kW diskharge lamp can be inserted into the sockets 91, 92, which are further removed from one another, of the twin sockets 9, 9'.

FIGS. 3 to 10 illustrate different configurations for forming sockets or socket pairs from socket parts, which are closed by two clamping pieces 6, 7 being brought together in translatory or rotary fashion in the direction of the arrows S indicated in FIGS. 3 to 10 and are opened by the clamping pieces 6, 7 being moved apart from one another in the direction of the arrows O indicated in FIGS. 3 to 10. Given in each case the same geometry of the socket parts, FIGS. 3, 5, 7 and 9 show the formation of sockets or socket pairs by means of the clamping pieces 6, 7 being brought together in linear and translatory fashion, while FIGS. 4, 6, 8 and 10 show the formation of sockets or socket pairs by means of the clamping pieces 6, 7 being pivoted, i.e. rotated about predetermined articulation points.

Figure 10:
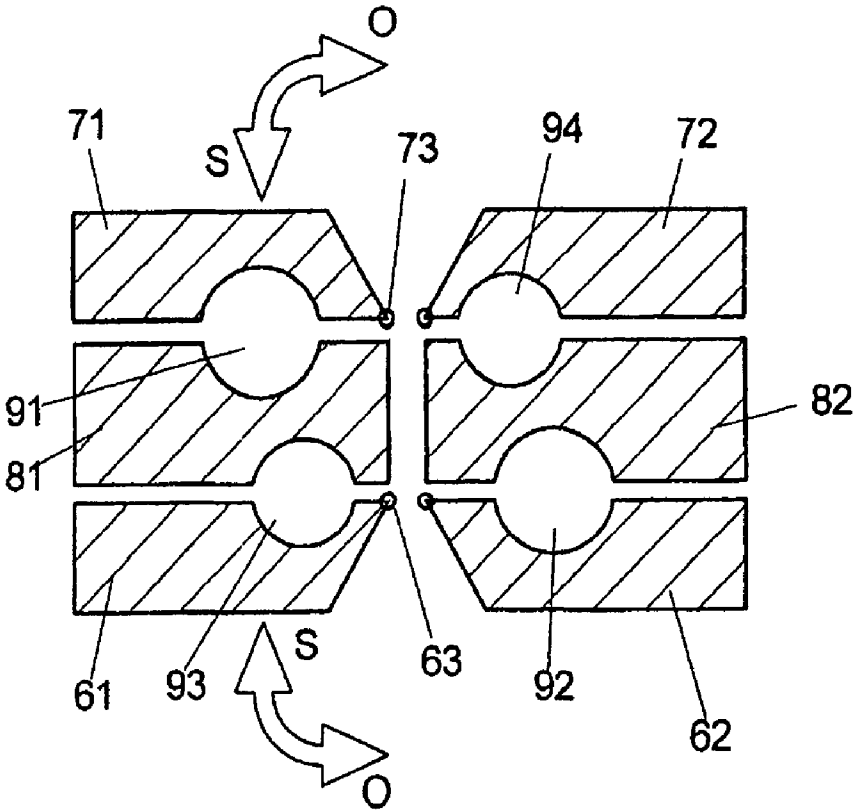
FIG. 10 shows a schematic configuration of clamping pieces which are capable of moving in rotary fashion for forming round or cylindrical sockets for the contact pins of a luminous means.
Figure 9:
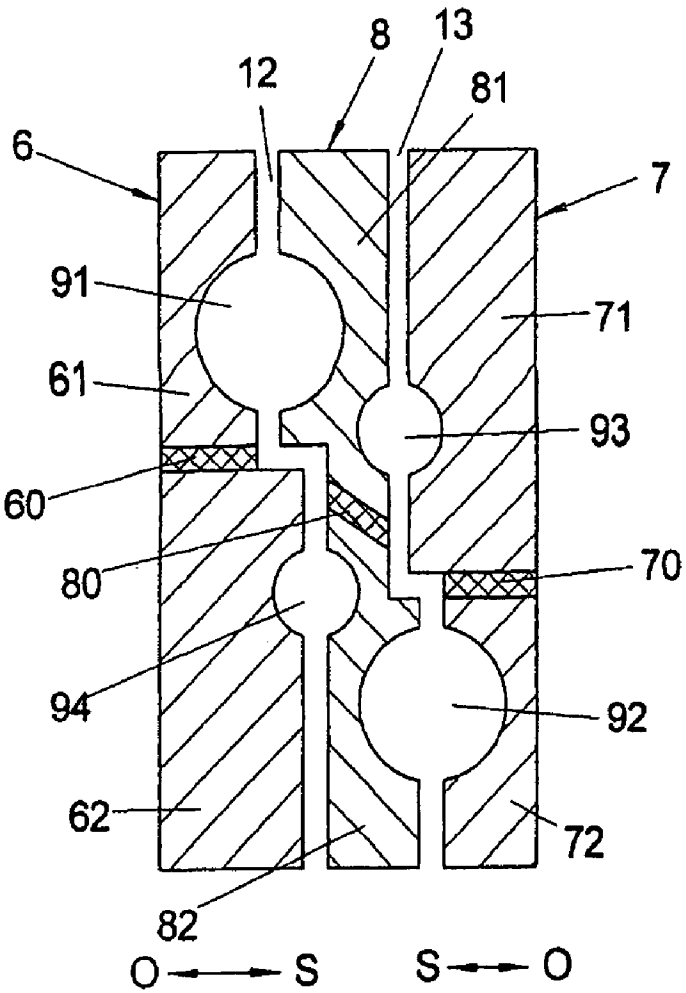
FIG. 9 shows a schematic configuration of clamping pieces which are capable of moving in translatory fashion for forming round or cylindrical sockets for the contact pins of a luminous means.

In the embodiment shown in FIGS. 9 and 10, in addition a passive intermediate clamping piece 8 is provided between the clamping pieces 6, 7, which passive intermediate clamping piece 8 forms the respective sockets or socket pairs 91 to 94 with the clamping pieces 6, 7 on both sides.

The clamping pieces 6, 7 are divided into first and second or upper and lower or right-hand and left-hand clamping piece parts 61, 62 and 71, 72, respectively, depending on the opening and closing direction of the clamping piece parts 61, 62 and 71, 72 and are associated with the respective poles for the voltage supply of the luminous means to be inserted into the luminous means holder and connected to them. The clamping pieces 6, 7 preferably comprise metal jaws, either a sufficient distance for potential isolation or an insulating layer 60, 70, 80 being provided between the upper and lower clamping piece part 61, 62 or 71, 72 or intermediate clamping piece part 81, 82. Socket parts in the form of round or semi-cylindrical recesses which, when the clamping pieces 6, 7 are brought together in the direction of the arrow S, form two socket pairs 91 to 94, are provided on the mutually facing connecting faces 10 of the clamping pieces 6, 7 or clamping piece parts 61, 62 and 71, 72 or mutually facing connecting faces 12, 13 of the clamping pieces 6, 7 or clamping piece parts 61, 62 and 71, 72 and the intermediate clamping piece 8 or the intermediate clamping piece parts 81, 82.

Figure 3:
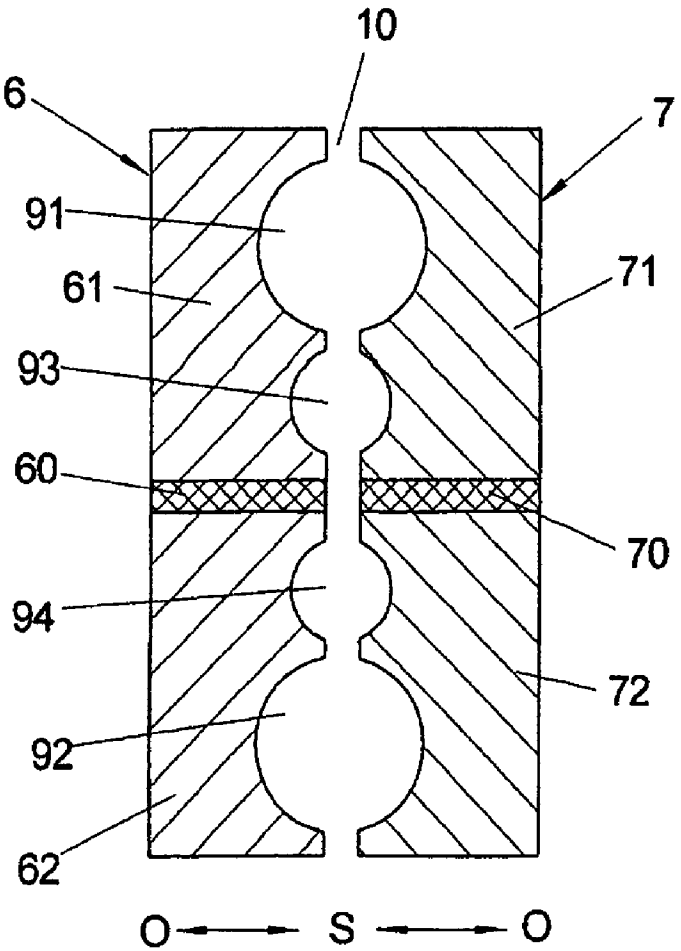
FIG. 3 shows a schematic configuration of clamping pieces which are capable of moving in translatory fashion for forming round or cylindrical sockets for the contact pins of a luminous means.

In the embodiment shown in FIG. 3, two socket pairs 91, 92 and 93, 94 are formed by the clamping pieces 6, 7 being brought together, of which socket pairs 91, 92 and 93, 94 the outer socket pair 91, 92 has a larger diameter than the inner socket pair 93, 94 and the distance between the two socket pairs 91, 92 and 93, 94 is dimensioned such that the inner socket pair 93, 94 is arranged completely within the outer socket pair 91, 92. The socket pairs 91, 92 and 93, 94, for the purpose of closing the contacts, are brought together as far as is made necessary by the diameter and/or the cross-sectional shape of the contact pins of the luminous means or the required clamping force.

Figure 4:
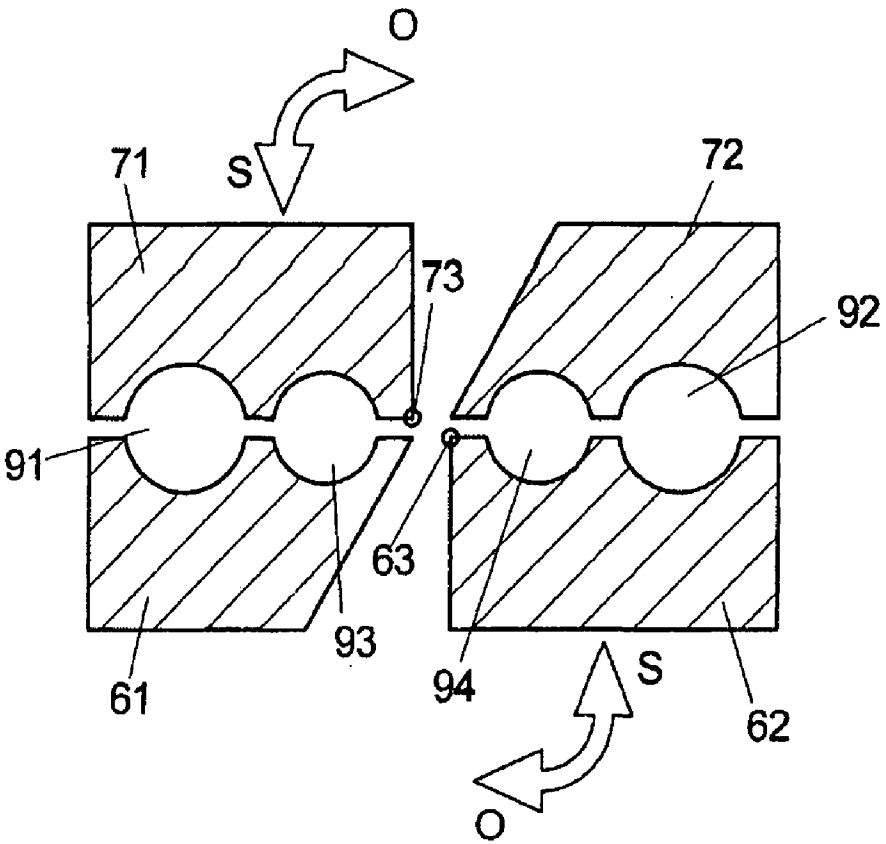
FIG. 4 shows a schematic configuration of clamping pieces which are capable of moving in rotary fashion for forming round or cylindrical sockets for the contact pins of a luminous means.

FIG. 4 illustrates an embodiment in which the clamping piece parts 62, 71 are capable of being pivoted about articulation points 63, 73, while the respective other clamping piece parts 61, 72 have beveled faces, so that the clamping piece parts 62, 71 can be opened in the direction of the arrow O by means of being pivoted about the articulation points 63, 73 and can be closed in the direction of the arrow S so as to form the socket pairs 91, 92 and 93, 94.

If the diameter of the contact pins of the luminous means to be accommodated increases in comparison with their distance from one another, the embodiments shown in FIGS. 5 to 10 also make it possible for different types of such luminous means to be accommodated, in each case two socket pairs 91, 92 and 93, 94 being shown in the exemplary embodiments illustrated, but it also being possible for further socket pairs to be provided on the basis of the same principle.

Figure 6:
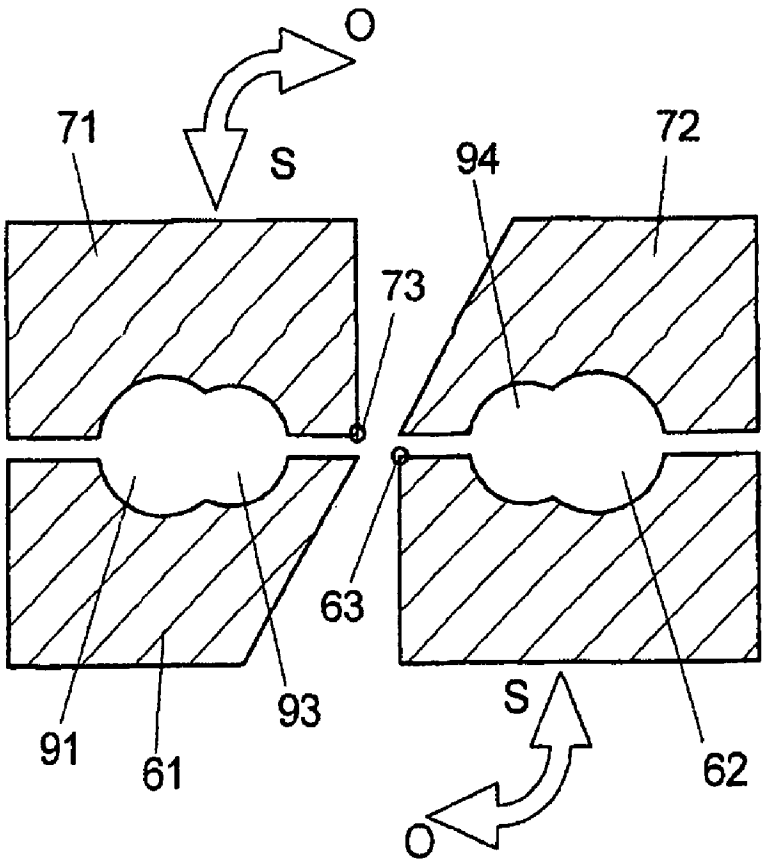
FIG. 6 shows a schematic configuration of clamping pieces which are capable of moving in rotary fashion for forming round or cylindrical sockets for the contact pins of a luminous means.
Figure 5:
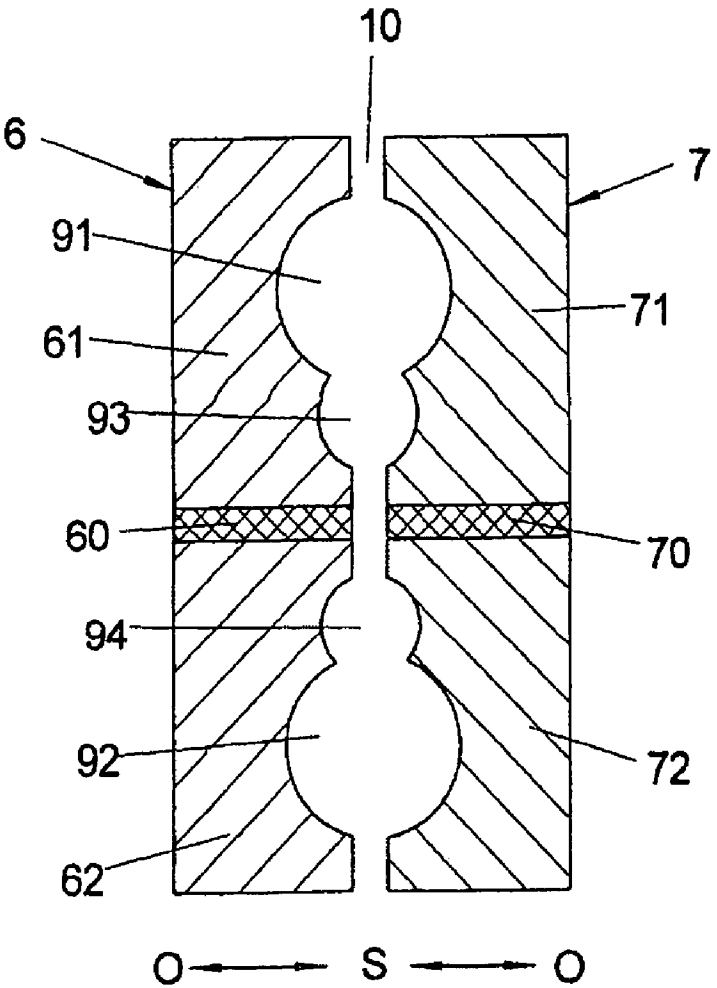
FIG. 5 shows a schematic configuration of clamping pieces which are capable of moving in translatory fashion for forming round or cylindrical sockets for the contact pins of a luminous means.

In the embodiments shown in FIGS. 5 and 6, the socket pairs 91, 92 and 93, 94 merge partially with one another and serve the purpose of accommodating contact pins of different luminous means, whose distance from one another is smaller given the same diameter as in the luminous means holder shown in FIGS. 3 and 4. Despite the fact that the sockets 91, 93 and 92, 94 merge partially with one another, sufficiently permanent contact-making of the sockets 91, 92 and 93, 94 with the contact pins of the various luminous means is ensured since the contact pins are surrounded by more than half by the sockets 91 to 94.

In this variant of the solution according to the invention, too, FIG. 5 shows a translatory adjustment of the clamping pieces 6, 7, while FIG. 6 illustrates a rotation of the clamping piece parts 62, 71 about articulation points 63, 73 for opening and closing the sockets or socket pairs 91 to 94.

The arrangement of the socket pairs 91, 92 and 93, 94 shown in FIGS. 5 and 6 is of course in principle also suitable for accommodating contact pins of different luminous means, whose diameter, given the same distance from one another, is greater than for luminous means to be accommodated in the luminous means holder as shown in FIGS. 3 and 4.

Figure 8:
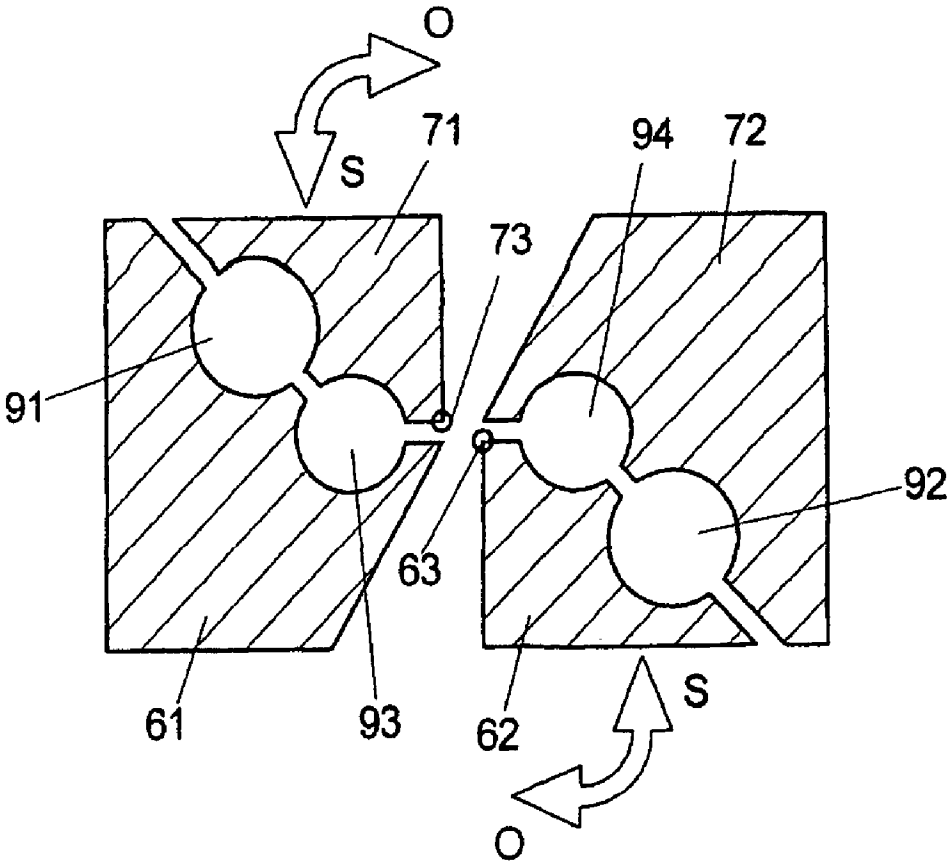
FIG. 8 shows a schematic configuration of clamping pieces which are capable of moving in rotary fashion for forming round or cylindrical sockets for the contact pins of a luminous means.
Figure 7:
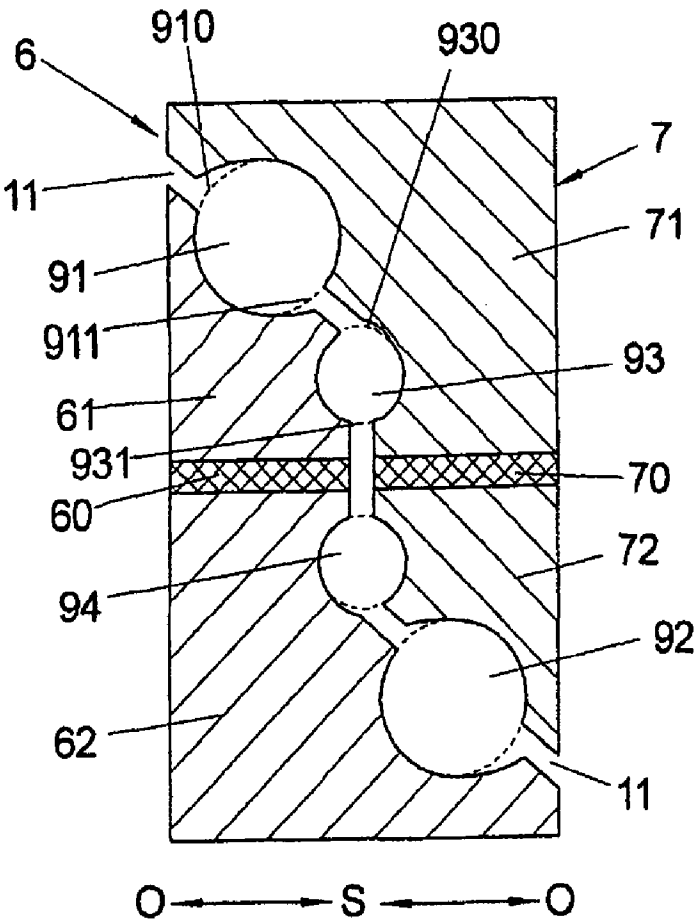
FIG. 7 shows a schematic configuration of clamping pieces which are capable of moving in translatory fashion for forming round or cylindrical sockets for the contact pins of a luminous means.

As an alternative to the arrangement of the sockets or socket pairs 91 to 94 shown in FIGS. 5 and 6, the separating line or connecting face 11 can also be angled or bent between the clamping pieces 6, 7 shown in FIGS. 7 and 8, so that, given a slight increase in the width of the clamping pieces 6, 7, a plurality of socket pairs 91, 92 and 93, 94 can be formed without them merging with one another.

In the arrangement shown in FIGS. 7 and 8, further space can be created for the arrangement of additional socket pairs by means of sockets or socket pairs 91 to 94 partially overlapping one another, so that a luminous means holder is formed so as to accommodate more than two different luminous means. An alternative embodiment or means for accommodating further sockets would be a widening of the clamping pieces 6, 7.

In this arrangement, FIG. 7 shows a translatory adjustment of the clamping pieces 6, 7, while FIG. 8 illustrates a rotation of the clamping piece parts 62, about articulation points 63, 73 for opening and closing the sockets or socket pairs 91 to 94.

The socket parts of sockets or socket pairs 91 to 94 which are arranged at an angle or bent with respect to one another are shaped in such a way that, when they are joined together, they provide the desired cross section, i.e. in the case of, for example, semicircular socket parts, those sections 910, 911 of the sockets 91, 92 and 930 of the sockets 93, 94 which are adjacent to the separating line are flattened in order that the socket parts do not interlock when the clamping pieces are brought together. Those sections 931 of the sockets 93, 94 which are adjacent to the separating line, on the other hand, are oriented towards one another since they are aligned at right angles to the separating line. Correspondingly, the degree of flattening increases with increasing distance from the perpendicular separating line, which is indicated in FIG. 7 by the different imaginary tangential extensions (illustrated by dashed lines) of the sections 910, 911 and 930.

Given a further reduction in the distance between the contact pins in relation to their diameter, an arrangement as shown in FIGS. 9 and 10 is expedient in which the socket parts are arranged closer together in comparison with their diameter than in FIGS. 3 to 8 described above or which are intended and suitable for forming further sockets or socket pairs for contact pins with different distances from one another and diameters.

In the arrangement shown in FIGS. 9 and 10, a passive, i.e. non-moving intermediate clamping piece 8 is provided, which comprises an upper and lower intermediate clamping piece part 81, 82 in which socket parts are provided in the form of semicylindrical recesses, which correspond to the semicylindrical socket parts of the clamping piece parts 61, 62, 71, 72. As a result of the clamping pieces 6, 7 being brought together, in the exemplary embodiment illustrated in FIG. 9 two socket pairs 91, 92 and 93, 94 are formed, which are arranged very close to one another in relation to their diameter in comparison with the socket pairs 91, 92 and 93, 94 described above in connection with FIGS. 3 to 8.

In the embodiment shown in FIG. 10, the clamping piece parts 61, 71 are capable of pivoting about the articulation points 63, 73 and have, as do the clamping piece parts 62, 72 associated with them, beveled faces, which adjoin the articulation points 63, 73 and make it possible for the clamping piece parts 61, 71 to pivot about the articulation points 63, 73 in the direction of the arrows S and O for closing and opening the sockets or socket pairs 91 to 94, which are formed from the socket parts provided in the clamping piece parts 61, 62 and 71, 72 and the intermediate clamping piece parts 81, 82.

Figure 11:
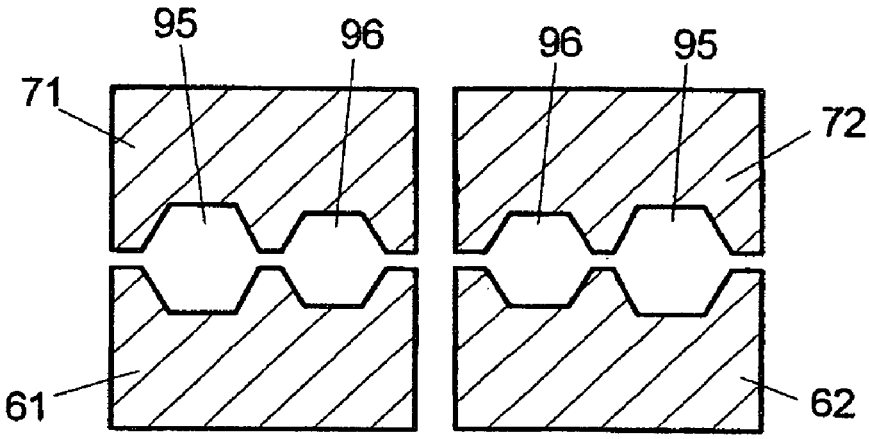
FIG. 11 shows movable clamping pieces for forming hexagonal sockets for the contact pins of a luminous means.
Figure 12:
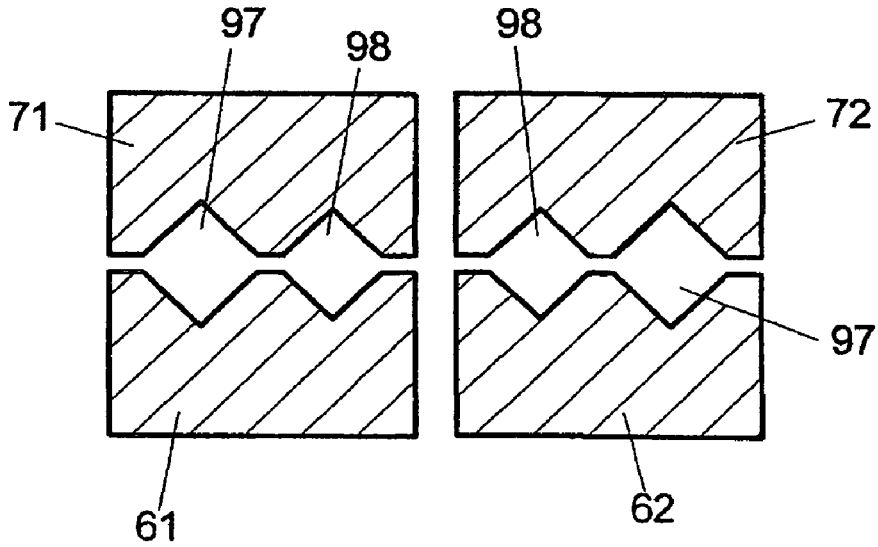
FIG. 12 shows movable clamping pieces for forming rectangular sockets for the contact pins of a luminous means.

In FIGS. 3 to 10 described above, semicircular or part-circular socket parts for forming cylindrical sockets or socket pairs are provided, but the invention also permits other geometries of the sockets or socket pairs which are possibly matched to the geometry of the contact pins of the luminous means. As exemplary embodiments of this, clamping piece parts 61, 62; 71, 72 are illustrated in FIGS. 11 and 12, in which clamping piece parts 61, 62; 71, 72 socket parts are provided which, as shown in FIG. 11, provide hexagonal sockets or socket pairs 95, 96 or, as shown in FIG. 12, provide rectangular sockets or socket pairs 97, 98. Further possible geometries are oval or ellipsoidal sockets, square sockets or the like.

Figure 13:
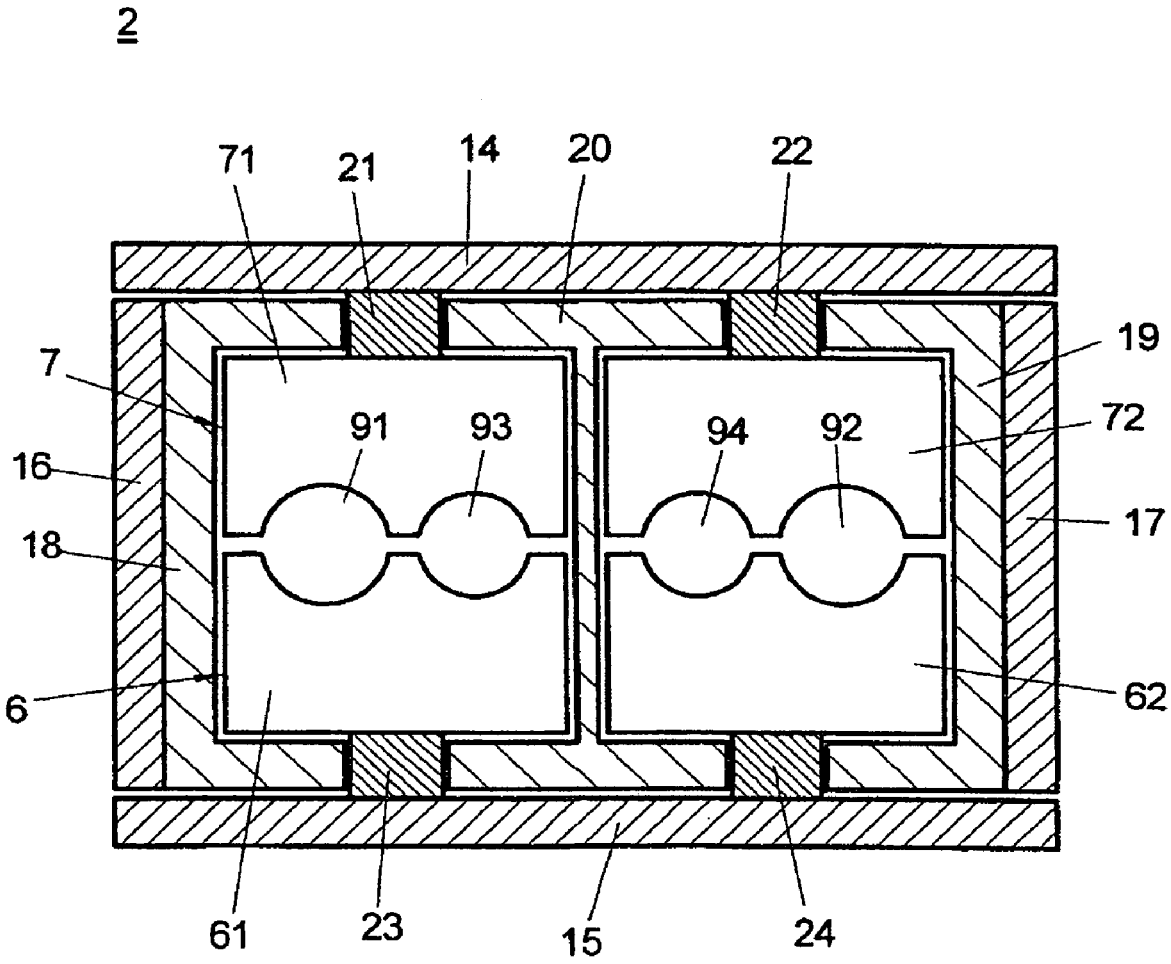
FIG. 13 shows a schematic illustration of a modular design for a luminous means holder with a universal holder frame for accommodating different socket inserts.

FIG. 13 illustrates an exemplary embodiment of a lampholder 2, which is suitable for accommodating a large number of luminous means and is characterized by a modular design. The modular luminous means holder has a universal holder frame 14 to 17, which is suitable for accommodating a maximum luminous means holder for a spotlight having a specific power and physical size and, as a result of various types of inserts, is also suitable for accommodating relatively small luminous means holders. For example, the universal holder frame 14 to 17 is dimensioned so as to accommodate luminous means holders of the size G 22, in which inserts for accommodating relatively small luminous means holders of the size G 12, GY 9.5 etc. can then be inserted.

The universal holder frame comprises movable frame parts 14, 15 and fixed frame parts 16, 17, of which the movable frame parts 14, 15 press together the clamping pieces 6, 7 or clamping piece parts 61, 62 and 71, 72 once the contact pins of a luminous means have been inserted. The inserts comprise socket inserts 18, 19, 20, of which, in the exemplary embodiment illustrated in FIG. 13, two socket inserts 18, 19 are in the form of a U-shaped box and are connected to the fixed frame parts 16, 17. A centrally arranged socket insert 20 is in the form of a double T and with its outer flanks bears against the movable frame parts 14, 15 of the universal holder frame. The bracket-shaped recesses of the socket inserts 18, 19, 20 accommodate the clamping pieces 6, 7 and clamping piece parts 61, 62; 71, 72 and can be separated from one another for the purpose of accommodating contact pins of a luminous means by the movable frame parts 14, 15 being moved apart from one another or can be closed so as to form sockets 91 to 94 by the movable frame parts 14, 15 being brought together.

The transmission of forces between the movable frame parts 14, 15 and the clamping pieces 6, 7 or clamping piece parts 61, 62; 71, 72 takes place either via correspondingly shaped clamping pieces 6, 7, which are formed with a shoulder for passing through the socket inserts 18, 19, 20, or, as shown in FIG. 13, as a result of the arrangement of struts 21 to 24 between the insides of the movable frame parts 14, 15 and the outer faces, which face away from the socket parts, of the clamping pieces 6, 7 or clamping piece parts 61, 62; 71, 72.

The universal holder frame illustrated in FIG. 13 can also be transferred in a similar way to clamping pieces or clamping piece parts which are arranged such that they are capable of performing a rotary movement and which are arranged between fixed and movable frame parts and socket inserts and struts which may be inserted.

The clamping pieces 6, 7 or clamping piece parts 61, 62; 71, 72 can be shaped so as to have a further configuration in such a way that they can be rotated through 180° in order to be able to set, for example, a different distance between or different diameters of the sockets or socket pairs 91 to 94. This embodiment makes it possible, inter alia, to replace corroded sockets by rotating the clamping pieces, so that a socket pair, which is positioned on the inside, for example, is moved outward by the rotation of the clamping pieces, so that uncorroded, perfect socket pairs are provided on the inside and perfect electrical contact with the contact pins of a correspondingly dimensioned luminous means is produced.

The various embodiments described above for forming lampholders with sockets of different configurations for accommodating luminous means with contact pins, whose diameters and distance from one another vary, can be modified and extended in a variety of ways.

The invention claimed is:

1. A luminous means holder apparatus for making electrical contact with a luminous means in spotlights, said luminous means comprising a glass vessel, a luminous means base and longitudinally extending contact pins for a power supply, each contact pin having a longitudinal axis, the luminous means holder apparatus comprising at least two socket pairs for accommodating the contact pins of different types of luminous means, wherein the socket pairs are formed from opposing socket parts having mutually opposite connecting faces, wherein said mutually opposite connecting faces are separable from each other for receiving the contact pins of the luminous means and said mutually opposite connecting faces can be guided towards one another and transversely to said contact pins' longitudinal axis to make electrical contact with the contact pins of the luminous means.

2. The apparatus of claim 1, wherein each socket pair forms a socket, and wherein the sockets of the socket pairs have different distances from one another and/or diameters.

3. The apparatus of claim 1, wherein the socket pairs are arranged symmetrically with respect to an axis of symmetry of the luminous means holder.

4. The apparatus of claim 1, wherein the socket pairs are arranged in such a way that they are offset with respect to one another in relation to at least one axis of symmetry of the luminous means holder.

5. The apparatus of claim 1, wherein connecting lines of the socket pairs form different angles with respect to an axis of symmetry of the luminous means holder.

6. The apparatus of claim 1, wherein the socket pairs are arranged such that they are separated from one another.

7. The apparatus of claim 1, wherein the socket pairs merge at least partially with one another.

8. The apparatus of claim 1, wherein each socket pair forms a socket, and wherein for luminous means with different power consumptions and/or power outputs, the distance between and/or the diameter of the sockets increase with the increasing power consumption and/or power output of the luminous means.

9. The apparatus of claim 1, wherein one of the connecting faces is angled and/or bent at right angles to an adjustment direction of the socket parts.

10. The apparatus of claim 1, wherein the socket parts are in the form of metal jaws.

11. The apparatus of claim 1, wherein socket inserts and/or socket parts can be rotated through 180° in a section plane with respect to the contact pins of the luminous means.

12. The apparatus of claim 1, wherein socket inserts and/or the socket parts can be rotated through 180° at right angles to a section plane with respect to the contact pins of the luminous means.

13. The apparatus of claim 1, wherein sockets are formed from socket parts, which are arranged in clamping pieces.

14. The apparatus of claim 13, wherein the socket parts are formed on the mutually opposite connecting faces formed on the clamping pieces.

15. The apparatus of claim 14, wherein the socket parts are designed to be asymmetrical in relation to the connecting faces of the clamping pieces.

16. The apparatus of claim 15, wherein the socket parts are designed to be semicylindrical.

17. The apparatus of claim 15, wherein the socket parts are designed to be polygonal.

18. The apparatus of claim 14, wherein the socket parts are designed to be symmetrical.

19. The apparatus of claim 18, wherein the socket parts are designed to be semicylindrical.

20. The apparatus of claim 18, wherein the socket parts are designed to be polygonal.

21. The apparatus of claim 1, wherein the socket parts for the purpose of electrically isolating sockets formed by said socket parts, have insulation, which runs substantially at right angles to the connecting faces.

22. The apparatus of claim 21, wherein the insulation is in the form of a distance between the socket parts which contain sockets of one pole and the socket parts which contain sockets of another pole.

23. The apparatus of claim 21, wherein the insulation is in the form of an insulating layer between the socket parts which contain sockets of one pole and the socket parts which contain sockets of another pole.

24. The apparatus of claim 1, wherein the socket parts are connected to one another in articulated fashion at their ends which are opposite sockets formed by said socket parts.

25. The apparatus of claim 24, wherein the socket parts are preferably prestressed in a sprung manner in a joining direction.

26. The apparatus of claim 1, wherein the luminous means holder has a holder frame, into which different, replaceable socket inserts can be inserted.

27. The apparatus of claim 26, wherein the socket inserts contain the socket parts and supporting elements, which are arranged at least partially between the socket parts and the holder frame.

28. The apparatus of claim 26, wherein the holder frame comprises fixed frame parts and movable frame parts, which are each associated with a socket part.

29. The apparatus of claim 28, wherein the movable frame parts are operatively connected to the socket parts.

30. The apparatus of claim 28, wherein struts are arranged between the movable frame parts and the socket parts.

31. The apparatus of claim 1, wherein at least one passive intermediate clamping piece is arranged between the connecting faces.

32. The apparatus of claim 31, wherein the connecting faces or the socket parts and the least one intermediate clamping piece is angled and/or bent at right angles to an adjustment direction of the socket parts.

33. The apparatus of claim 31, wherein the socket parts or the intermediate clamping pieces are in the form of metal jaws.

34. The apparatus of claim 31, wherein the socket parts and/or the at least one intermediate clamping piece, for the purpose of electrically isolating sockets formed by said socket parts, have insulation, which runs substantially at right angles to the connecting faces.

35. The apparatus of claim 34, wherein the insulation is in the form of a distance between the socket parts or the at least one intermediate clamping piece which contain sockets of one pole and the socket parts or the at least one intermediate clamping piece which contain sockets of another pole.

36. The apparatus of claim 34, wherein the insulation is in the form of an insulating layer between the socket parts or the at least one intermediate clamping piece which contain sockets of one pole and the socket parts or the at least one intermediate clamping piece which contain the sockets of another pole.

37. The apparatus of claim 31, wherein the socket parts are connected to one another in articulated fashion at their ends which are opposite sockets formed by said socket parts.

38. The apparatus of claim 37, wherein the socket parts or the at least one intermediate clamping piece are preferably prestressed in a sprung manner in a joining direction.

* * * * *